US009405230B2

(12) United States Patent
Akedo

(10) Patent No.: US 9,405,230 B2
(45) Date of Patent: Aug. 2, 2016

(54) TRANSPORTING APPARATUS, DEVELOPING APPARATUS AND IMAGE FORMING APPARATUS

(71) Applicant: Sharp Kabushiki Kaisha, Osaka-shi, Osaka (JP)

(72) Inventor: Shuichi Akedo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/680,241

(22) Filed: Apr. 7, 2015

(65) Prior Publication Data

US 2015/0301477 A1 Oct. 22, 2015

(30) Foreign Application Priority Data

Apr. 18, 2014 (JP) ..... 2014-085959

(51) Int. Cl.
*G03G 15/08* (2006.01)

(52) U.S. Cl.
CPC ..... *G03G 15/0893* (2013.01); *G03G 15/0879* (2013.01); *G03G 2215/0132* (2013.01)

(58) Field of Classification Search
CPC ..... G03G 15/0844; G03G 15/0893; G03G 15/0879; G03G 2215/0132
See application file for complete search history.

(56) References Cited

U.S. PATENT DOCUMENTS 5,436,703 A * 7/1995 DeYoung ..... G03G 15/0844 399/256
2006/0165440 A1* 7/2006 Adachi ..... G03G 15/0844 399/254
2006/0239720 A1* 10/2006 Hirota ..... G03G 15/0877 399/258
2007/0098448 A1* 5/2007 Hart ..... G03G 15/09 399/254
2007/0183813 A1* 8/2007 Iwata ..... G03G 15/0877 399/227
2007/0269235 A1* 11/2007 Hirose ..... G03G 15/0868 399/254
2008/0170885 A1* 7/2008 Hatakeyama ..... G03G 15/0877 399/254
2008/0187332 A1* 8/2008 Tsuda ..... G03G 15/0898 399/27
2009/0103952 A1* 4/2009 Sakamoto ..... G03G 15/0877 399/258
2009/0214232 A1* 8/2009 Murauchi ..... G03G 15/0849 399/30
2009/0214233 A1* 8/2009 Murauchi ..... G03G 15/0877 399/30

(Continued)

FOREIGN PATENT DOCUMENTS

JP 2005-221852 A 8/2005

*Primary Examiner* — David Bolduc
(74) *Attorney, Agent, or Firm* — Keating & Bennett, LLP

(57) ABSTRACT

A developing apparatus includes a developer vessel that is provided with a first transporting path, a second transporting path and a third transporting path. The first transporting path and the second transporting path are communicated with each other, and a developer is circulated in the first transporting path and the second transporting path. The third transporting path is provided in an upstream side in a transporting direction of the developer in the second transporting path. If a toner is consumed while forming an image on a paper, a toner corresponding to a consumption amount is resupplied together with a carrier from a toner cartridge to the developer vessel. A carrier and/or a developer that overflows from the second transporting path to the third transporting path is discharged from a discharge port.

11 Claims, 9 Drawing Sheets

(56) References Cited

U.S. PATENT DOCUMENTS

2009/0214266 A1* 8/2009 Kato ..... G03G 15/0877 399/254
2009/0245879 A1* 10/2009 Minami ..... G03G 15/0822 399/255
2009/0290886 A1* 11/2009 Murauchi ..... G03G 15/0844 399/27
2009/0290887 A1* 11/2009 Murauchi ..... G03G 15/0844 399/27
2009/0310984 A1* 12/2009 Sakatani ..... G03G 15/0856 399/30
2009/0310985 A1* 12/2009 Hirata ..... G03G 15/0853 399/30
2009/0317141 A1* 12/2009 Okazaki ..... G03G 15/0877 399/254
2010/0215406 A1* 8/2010 Ozawa ..... G03G 15/0808 399/257
2010/0303507 A1* 12/2010 Isono ..... G03G 15/0893 399/254
2010/0322671 A1* 12/2010 Tsutsui ..... G03G 15/0887 399/254
2011/0013944 A1* 1/2011 Kawaguchi ..... G03G 15/0877 399/257
2011/0150537 A1* 6/2011 Watanabe ..... G03G 15/0839 399/256
2011/0170888 A1* 7/2011 Suzaki ..... G03G 15/0822 399/53
2011/0229209 A1* 9/2011 Takaya ..... G03G 15/0844 399/257
2011/0236074 A1* 9/2011 Maeda ..... G03G 15/0893 399/254
2011/0311279 A1* 12/2011 Okazaki ..... G03G 15/0887 399/254
2012/0002983 A1* 1/2012 Kataoka ..... G03G 15/0877 399/12
2012/0070194 A1* 3/2012 Okuno ..... G03G 15/0893 399/254
2012/0189349 A1* 7/2012 Okuno ..... G03G 15/0189 399/254
2013/0223873 A1* 8/2013 Manabe ..... G03G 15/0844 399/102
2013/0343784 A1* 12/2013 Fujimura ..... G03G 15/0893 399/255
2014/0205311 A1* 7/2014 Kashimoto ..... G03G 15/0889 399/98
2014/0369718 A1* 12/2014 Furuta ..... G03G 15/0849 399/259
2015/0139696 A1* 5/2015 Ishida ..... G03G 15/0893 399/254
2015/0168871 A1* 6/2015 Sakamaki ..... G03G 15/0893 399/254

* cited by examiner

TRANSPORTING APPARATUS, DEVELOPING APPARATUS AND IMAGE FORMING APPARATUS

CROSS REFERENCE OF RELATED APPLICATION

The disclosure of Japanese patent application No. 2014-085959 filed on Apr. 18, 2014 is incorporated by reference.

BACKGROUND OF THE INVENTION

1. Field of the Invention

The present invention relates to a transporting apparatus, a developing apparatus and an image forming apparatus, and more specifically, a transporting apparatus that transports a developer within a developer vessel, and a developing apparatus and an image forming apparatus.

2. Description of the Related Art

One example of a related art is disclosed in Japanese patent application laying-open No. 2005-221852 [G03G 15/08] (Literature 1) laid-open on Aug. 18, 2005. In a developing apparatus disclosed in Literature 1, a trickle discharge port is formed in a part of a downstream side in a transporting direction of a developer transported by a supply auger in a developing housing. In such a developing apparatus, a part of surplus developer that a consumption amount of the developer is deducted from a resupply amount of the developer that consists of a toner and a carrier resupplied by a developer supply portion is sequentially discharged by a trickle mechanism. Furthermore, in this developing apparatus, a backflow generating auger having a winding direction reverse to a winding direction of the supply auger is provided in an upstream side than the trickle discharge port in a transporting direction by the supply auger. Furthermore, a gap area between the trickle discharge port and an outer periphery of the backflow generating auger is narrowed locally in an upside of the backflow generating auger. Therefore, a discharge amount of a developer is regulated.

Although an amount of waste developer is regulated in the above-mentioned related art by providing the backflow generating auger and by narrowing locally in the upside of the backflow generating auger, the backflow generating auger is provided on an extension line of the same axis as that of the supply auger. Therefore, the developer transported by the supply auger reaches the trickle discharge port by its impetus, and the regulation of the amount of waste developer is not enough. Furthermore, although the above-mentioned related art discloses that the backflow generating auger is also provided in the development housing in addition to the supply auger, specific structure is not clear.

SUMMARY OF THE INVENTION

Therefore, it is a primary object of the present invention to provide a transporting apparatus, developing apparatus and an image forming apparatus, capable of preventing a developer from being discharged excessively.

A transporting apparatus according to a first invention comprises a first transporting member, a second transporting member, a third transporting path and a third transporting member. For example, the first transporting member and the second transporting member are provided side by side in a developer vessel. The first transporting member transports a developer while churning in a first transporting path in a developer vessel. Furthermore, the second transporting member transports a developer while churning in a direction reverse to the first transporting member in a second transporting path that is arranged in parallel with the first transporting path, and supplies the developer to a developer bearing member such as a developing roller. The third transporting path is connected to the second transporting path in an upstream side of a transporting direction of the developer by the second transporting member. The third transporting member transports the developer that overflows from the second transporting path to a discharge port that is formed in the third transporting path.

According to the first invention, since the developer overflowing from the second transporting path to the third transporting path is discharged, the developer is discharged without influence due to an impetus of the developer transported in the first transporting path and the second transporting path. That is, the developer is prevented from being discharged excessively.

In the transporting apparatus according to a second invention, each of the second transporting path and the third transporting path is cylindrical or approximately cylindrical shape. The third transporting path has a diameter of the cylindrical shape smaller (narrower) than that the second transporting path, and is formed coaxially with the second transporting path.

According to the second invention, since the third transporting path is narrower than the second transporting path, even if a transporting apparatus inclines, a large amount of developer does not overflow toward the third transporting path from the second transporting path. That is, the developer is not discharged more than required.

In the transporting apparatus according to a third invention, the first transporting member is formed so as to reduce an impetus of the developer toward the transporting direction in a downstream side of the transporting direction of the developer.

According to the third invention, the developer transported in the first transporting path is prevented from being transported with the impetus not reduce on the second transporting path. Therefore, the developer transported in the first transporting path is prevented as possible from overflowing to the third transporting path due to own impetus. Therefore, the developer is effectively prevented from being discharged excessively.

In the transporting apparatus according to a fourth invention, the first transporting member has a screw for transporting the developer while churning. This screw is provided with a plate that extends radially from a center of a screw axis and is arranged in parallel with the screw axis on a part of an agitator groove in a position corresponding to a communicating portion between the first transporting path and the second transporting path in a downstream side of the transporting direction of the developer by the first transporting member. Therefore, the developer transported in the first transporting path stays in an upstream side of the transporting direction than a position that the plate is provided, whereby the impetus toward the transporting direction can be reduced.

According to the fourth invention, since the impetus toward the transporting direction of the developer transported in the first transporting path can be reduced, the developer is effectively prevented from being discharged excessively.

In the transporting apparatus according to a fifth invention, the first transporting member has a screw for transporting the developer while churning. A part of agitating vanes of this screw lacks in a position corresponding to a communicating portion between the first transporting path and the second transporting path in a downstream side of the transporting direction of the developer by the first transporting member.

Therefore, the developer transported in the first transporting path stays in an upstream side of the transporting direction than the position that a part of the agitating vanes lacks, whereby the impetus toward the transporting direction can be reduced.

In also the fifth invention, like the fourth invention, since the impetus of the developer transported in the first transporting path can be reduced, the developer is effectively prevented from being discharged excessively.

In the transporting apparatus according to a sixth invention, the first transporting member has a screw for transporting the developer while churning. Furthermore, in a downstream side of the transporting direction of the developer in the first transporting member, agitating vanes for transporting the developer in a direction reverse to the transporting direction by the first transporting member is provided up to a position corresponding to the communicating portion between the first transporting path and the second transporting path. Therefore, in the first transporting path, the developer that stays in the downstream side of the transporting direction closes a part of the communicating portion.

According to the sixth invention, since a part of the communicating portion is closed by the developer that stays, the developer transported in the first transporting path is prevented as possible from being transported to the second transporting path as it is. Therefore, the developer is effectively prevented from being discharged excessively.

In the transporting apparatus according to a seventh invention, there is further formed with a blocking portion that blocks the developer from being directly transported from the first transporting path to the second transporting path in a position corresponding to the communicating portion between the first transporting path and the second transporting path in a downstream side of the transporting direction of the developer by the first transporting member.

According to the seventh invention, since the developer transported in the first transporting path can be prevented as possible from being transported to the second transporting path as it is, the developer is effectively prevented from being discharged excessively.

In the transporting apparatus according to an eighth invention, the blocking portion includes a wall that narrows a width of the communicating portion. For example, a partitioning plate (partition wall) provided between the first transporting path and the second transporting path may be extended, or one or two or more plates (walls) may be provided so as to divide the communicating portion.

According to the eighth invention, like the seventh invention, the developer is effectively prevented from being discharged excessively.

In the transporting apparatus according to a ninth invention, the blocking portion includes a part of the second transporting path that is extended toward an upstream side of the transporting direction of the developer by the second transporting member. Accordingly, a distance from the communicating portion to the third transporting path is lengthened. Therefore, the developer transported in the first transporting path is made difficult to overflow to the third transporting path with the impetus not reduce.

In also the ninth invention, since the distance from the communicating portion to the third transporting path is lengthened, the developer transported in the first transporting path is prevented as possible from overflowing to the third transporting path with the impetus not reduce. Therefore, the developer is effectively prevented from being discharged excessively.

A tenth invention is a developing apparatus comprising any one of the above-mentioned transporting apparatuses and a developer bearing member.

Also in the tenth invention, like the first invention, the developer is prevented from being discharged excessively.

An eleventh invention is an image forming apparatus comprising any one of the above-mentioned transporting apparatus.

Also in the eleventh invention, like the first invention, the developer is prevented from being discharged excessively.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
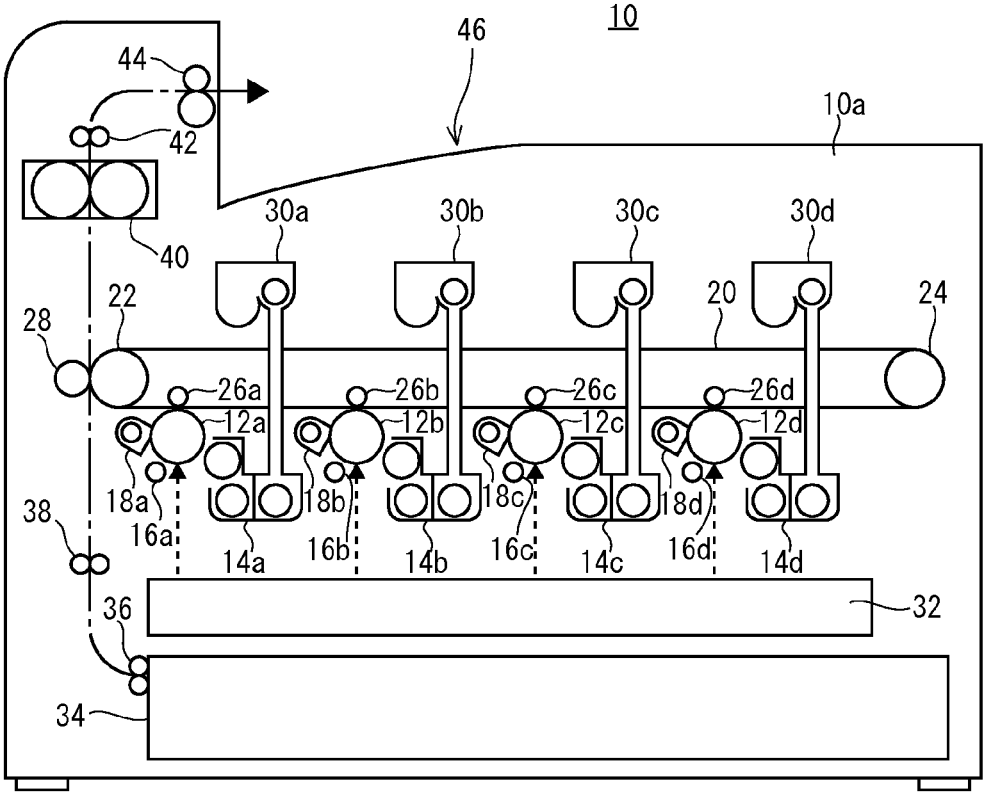
FIG. 1 is a schematic view showing an example of an outline of entire structure of an image forming apparatus of a first embodiment.

FIG. 1 is a schematic structural view viewing from the front a whole of an image forming apparatus 10 that is an embodiment according to the present invention.

With reference to FIG. 1, the image forming apparatus 10 of the first embodiment includes four photoreceptor drums 12*a*, 12*b*, 12*c* and 12*d*, and the photoreceptor drums 12*a*-12*d* are provided with predetermined intervals in the horizontal direction such that respective rotation axes are in parallel with each other. A developing apparatus 14*a*, a charger 16*a* and a cleaning unit 18*a* are provided around the photoreceptor drum 12*a*. A developing apparatus 14*b*, a charger 16*b* and a cleaning unit 18*b* are provided around the photoreceptor drum 12*b*. A developing apparatus 14*c*, a charger 16*c* and a cleaning unit 18*c* are provided around the photoreceptor drum 12*c*. Furthermore, a developing apparatus 14*d*, a charger 16*d* and a cleaning unit 18*d* are provided around the photoreceptor drum 12*d*.

Each of the developing apparatuses 14*a*, 14*b*, 14*c* and 14*d* is arranged such that a rotation axis of each of developing rollers is in parallel with the rotation axis of corresponding one of the photoreceptor drums 12*a*, 12*b*, 12*c* and 12*d*. Furthermore, each of the chargers 16*a*, 16*b*, 16*c* and 16*d* is arranged such that own axis is in parallel with the rotation axis of corresponding one of the photoreceptor drums 12*a*, 12*b*, 12*c* and 12*d*. Each of the cleaning units 18*a*, 18*b*, 18*c* and 18*d* is arranged such that a longitudinal direction of each cleaning blade corresponds to a direction of the rotation axis of corresponding one of the photoreceptor drums 12*a*, 12*b*, 12*c* and 12*d*. It should be noted that an axial direction of the rotation axis of each of the photoreceptor drums 12*a*, 12*b*, 12*c* and 12*d* is a depth direction when viewing the image forming apparatus 10 from the front.

The charger 16*a*, the developing apparatus 14*a* and the cleaning unit 18*a* are arranged in this order in a rotation direction of the photoreceptor drum 12*a* (counterclockwise in FIG. 1). The charger 16*b*, the developing apparatus 14*b* and the cleaning unit 18*b* are arranged in this order in a rotation direction of the photoreceptor drum 12*b* (counterclockwise in FIG. 1). The charger 16*c*, the developing apparatus 14*c* and the cleaning unit 18*c* are arranged in this order in a rotation direction of the photoreceptor drum 12*c* (counterclockwise in FIG. 1). The charger 16*d*, the developing apparatus 14*d* and the cleaning unit 18*d* are arranged in this order in a rotation direction of the photoreceptor drum 12*d* (counterclockwise in FIG. 1).

Furthermore, the image forming apparatus 10 includes an intermediate transfer belt 20 that is provided above the photoreceptor drums 12*a*-12*d* in the vertical direction. In addition, the intermediate transfer belt 20 is stretched over a driving roller 22 and a driven roller 24, and arrange such that a surface of the intermediate transfer belt 20 is brought into contact with surfaces of the photoreceptor drums 12*a*-12*d*.

Furthermore, above the photoreceptor drums 12*a*, 12*b*, 12*c* and 12*d* in the vertical direction, intermediate transfer rollers 26*a*, 26*b*, 26*c* and 26*d* for primary transfer are provided in a rear surface (inner periphery) side of the intermediate transfer belt 20 such that respective rotation axes are in parallel with each other. Furthermore, each of the rotation axes of the intermediate transfer rollers 26*a*, 26*b*, 26*c* and 26*d* is in parallel with corresponding one of the rotation axes of the photoreceptor drums 12*a*, 12*b*, 12*c* and 12*d*. The intermediate transfer roller 26*a* is provided in a position opposite to the photoreceptor drum 12*a*, the intermediate transfer roller 26*b* is provided in a position opposite to the photoreceptor drum 12*b*, the intermediate transfer roller 26*c* is provided in a position opposite to the photoreceptor drum 12*c*, and the intermediate transfer roller 26*d* is provided in a position opposite to the photoreceptor drum 12*d*. Furthermore, the intermediate transfer rollers 26*a*-26*d* are arranged to be brought into pressure-contact to corresponding photoreceptor drums 12*a*-12*d* from the inner periphery side of the intermediate transfer belt 20, respectively.

Furthermore, a cleaning unit for intermediate transfer belt 20 is provided in a position opposite to the driven roller 24 in one end side (right side in FIG. 1) of the intermediate transfer belt 20 in the horizontal direction. The cleaning unit is arranged such that a direction of a rotation axis of the driven roller 24 and a longitudinal direction of a cleaning blade correspond to each other.

Furthermore, a transfer roller 28 for secondary transfer is provided at a position opposite to the driving roller 22 in another end side (left side in FIG. 1) of the intermediate transfer belt 20 in the horizontal direction. The transfer roller 28 has a rotation axis that is in parallel with the rotation axis of the driving roller 22, and is arranged to be brought into pressure-contact to the driving roller 22 via the intermediate transfer belt 20.

Furthermore, above the developing apparatuses 14*a*, 14*b*, 14*c* and 14*d* in the vertical direction, toner cartridges 30*a*, 30*b*, 30*c* and 30*d* are provided via the intermediate transfer belt 20. Each of the toner cartridges 30*a*-30*d* is coupled (connected) to a toner resupply port that is formed in corresponding one of the developing apparatuses 14*a*-14*d*.

Furthermore, below the developing apparatuses 14*a*-14*d* in the vertical direction, an exposure device 32 is provided, and a paper feeding tray 34 is further provided below this exposure device 32. This paper feeding tray 34 is provided with a pickup roller 36. Furthermore, the image forming apparatus 10 includes a feeding roller 38, a fixing device 40, a transporting roller 42 and a discharge roller 44, and the feeding roller 38, the fixing apparatus 40, the transporting roller 42 and the discharge roller 44 are arranged in this order form an upstream side toward a downstream side of a direction that a paper picked by the pickup roller 36 is transported. In addition, the transfer roller 28 is provided between the feeding roller 38 and the fixing device 40.

Each of the above-mentioned components is accommodated within a housing 10*a* of the image forming apparatus 10, and as mentioned later, a recording medium (typically "paper") that an image is formed thereon is discharged to a discharge tray 46 on an upper surface of the housing 10*a* in the vertical direction.

The image forming apparatus 10 of such structure is a full color printer, for example, and can form a multicolor or monochromatic image on a recording medium according to image data that is input from an outside. However, the image forming apparatus 10 need not to be limited to a printer, and may be a copying apparatus, a facsimile or a multifunction apparatus possessed with these functions. Therefore, the image forming apparatus 10 can also form a multicolor or monochromatic image on a recording medium in accordance with not only the image data that is input from an outside but image data that is read from an original by a scanner.

Subsequently, respective components of the image forming apparatus 10 will be simply mentioned. As mentioned above, the photoreceptor drums 12*a*-12*d*, the developing apparatuses 14*a*-14*d*, the chargers 16*a*-16*d*, the cleaning units 18*a*-18*d*, the intermediate transfer rollers 26*a*-26*d* and the toner cartridges 30*a*-30*d* are distinguished from each other by using subscripts "a"-"d". However, the components that the same numerals are applied have the same function and perform the same operation or action. Accordingly, it is thinkable that there is no necessity of distinguishing especially. Therefore, in the following, it is simply represented as the photoreceptor drum 12, the developing apparatus 14, the charger 16, the cleaning unit 18, the intermediate transfer roller 26 and the toner cartridge 30 by omitting the subscripts "a"-"d".

It should be noted that in FIG. 1 and its description, the subscript "a" is given to each component for performing image formation about black (K). Furthermore, the subscript "b" is given to each component for performing image formation about cyan (C). Furthermore, the subscript "c" is given to each component for performing image formation about magenta (M). Then, the subscript "d" is given to each component for performing image formation about yellow (Y).

The photoreceptor drum 12 is supported to be rotated around the axis by a driving portion not shown, and includes a conductive substrate and a photoconductive layer formed on a surface of the conductive substrate (both not shown). The conductive substrate can take various kinds of forms or shapes, and a hollow cylindrical shape, a solid cylindrical shape, a shape of a thin film sheet, etc. can be cited, for example. The photoconductive layer is formed of a material that shows conductivity when irradiated with a light. As the photoreceptor drum 12 of the first embodiment, a thing comprising the cylindrical conductive substrate formed of aluminum and the photoconductive layer that is formed on an outer peripheral surface of the conductive substrate and is formed of amorphous silicon (a-Si), selenium (Se) or an organic photo-semiconductor (OPC) is used.

The developing apparatus 14 develops with a toner an electrostatic latent image formed on the surface of the photoreceptor drum 12. Accordingly, a toner image is formed on the surface of the photoreceptor drum 12. The toner cartridge 30 is connected to the developing apparatus 14 by a toner supply pipe. Details of the developing apparatus 14 will be mentioned later.

The charger 16 is a device that charges the surface of the photoreceptor drum 12 in a predetermined polarity and electrical potential. As the charger 16, a brush type charger, a roller type charger, a corona charger, an ion generator, etc. can be used.

The cleaning unit 18 removes and collects the toner that remains on the surface of the photoreceptor drum 12 after the toner image is transferred from the photoreceptor drum 12 by the intermediate transfer belt 20 to clean the surface of the photoreceptor drum 12. Therefore, the cleaning unit 18 comprises a cleaning blade for removing the toner and a recovery container for recovering the toner removed, for example.

The intermediate transfer belt 20 is an endless-belt-like member, and stretched over the driving roller 22 and the driven roller 24 to form a loop-like path. As shown in FIG. 1, when viewing the image forming apparatus 10 from the front, the intermediate transfer belt 20 is rotated clockwise (right-handed rotation).

The driving roller 22 is provided to be rotated around the axis by a driving portion not shown. The driving roller 22 rotates the above-mentioned intermediate transfer belt 20 by its rotation. The driven roller 24 is provided rotatably, and rotated following the rotation of the driving roller 22, and generates a constant tension on the above-mentioned intermediate transfer belt 20. Therefore, sag of the intermediate transfer belt 20 is prevented.

The intermediate transfer roller 26 is provided to be rotated around the axis by a driving portion not shown, and brought into pressure-contact to the photoreceptor drum 12 via the intermediate transfer belt 20. As the intermediate transfer roller 26, it is possible to use a thing that a conductive elastic member is formed on a surface of a metallic (stainless steel, for example) roller. Although not shown, a power supply that applies a transfer bias is connected to the intermediate transfer roller 26, and the toner image formed on the surface of the photoreceptor drum 12 is transferred to the surface of the intermediate transfer belt 20.

The transfer roller 28 is provided to be rotated around the axis by a driving portion not shown, and brought into pressure-contact to the driving roller 22 via the intermediate transfer belt 20. The toner image that is carried and transported by the intermediate transfer belt 20 is transferred to the paper that is fed from the paper feeding tray 34 in a pressure-contact portion (transfer nip portion) of the transfer roller 28 and the driving roller 22.

In addition, although not shown, a transfer belt cleaning unit is provided to be opposite to the driven roller 24 via the intermediate transfer belt 20 and brought into contact with the surface (toner image bearing surface) of the intermediate transfer belt 20. The transfer belt cleaning unit removes and recovers the toner that remains on the surface of the intermediate transfer belt 20 after the transfer of the toner image to a paper.

As mentioned above, the toner cartridge 30 is arranged above the developing apparatus 14 in the vertical direction, and stores an unused toner and an unused carrier. The toner cartridge 30 supplies (resupplies) a toner to the developing apparatus 14 through a toner supply pipe and resupplies a carrier.

The exposure device 32 emits a light and an emitted light is irradiated to the surface of the photoreceptor drum 12 from a space between the charger 16 and the developing apparatuses 14. Therefore, an electrostatic latent image is formed on the surface of the photoreceptor drum 12. As the exposure device 32, it is possible to use a laser scanning unit (LSU) that comprises a laser irradiating portion and a plurality of reflecting mirrors, for example.

The fixing device 40 comprises a hot roller and a pressure roller. The hot roller is controlled to become a predetermined fixing temperature. The pressure roller is a roller that is brought into pressure-contact to the hot roller to sandwich a recording medium together with the hot roller while hotting. Therefore, the toner forming a toner image is melted and fixed on the recording medium.

The photoreceptor drum 12 is charged by the charger 16 with instructions from a CPU (Central Processing Unit: not shown) that controls a whole of the image forming apparatus 10. Next, the exposure device 32 forms the electrostatic latent image according to input image data on the surface of the photoreceptor drum 12.

Subsequently, the developing apparatus 14 develops the electrostatic latent image formed on the surface of the photoreceptor drum 12. That is, a toner image is formed. Then, the toner image formed on the surface of the photoreceptor drum 12 is transferred to the intermediate transfer belt 20 by the intermediate transfer roller 26. Furthermore, the toner that remains on the surface of the photoreceptor drum 12 is removed and recovered by the cleaning unit 18. Furthermore, the toner that remains on the surface of the intermediate transfer belt 20 is removed and recovered by the transfer belt cleaning unit.

The pickup roller 36 picks up a paper that is a recording medium from the paper feeding tray 34. The paper that is picked up is transported to the transfer roller 38 via the feeding roller 38. Therefore, the toner image on the surface of the intermediate transfer belt 20 is transferred to the paper while the paper passes the transfer nip portion, and the paper that the toner image is transferred is transported to the fixing device 40. The toner image that is transferred to the paper is fixed by the fixing device 40, and the paper that the toner image is fixed is discharged to the discharge tray 46 with the transporting roller 42 and the discharge roller 44.

In such an image forming apparatus 10, the developer (two-component developer) composed of a toner of black, cyanogen, magenta or yellow and a carrier is stored in the developer vessel 140 that is included in the developing apparatus 14 as mentioned later. In addition, the carrier is a magnetic material such as an iron powder or a ferrite. The same applies hereinafter.

The developing apparatus 14 is a developing apparatus of a trickle development system, for example. In the trickle development system, briefly describing, a carrier is mixed to a toner in the toner cartridge 30 with a constant ratio, and a new carrier (unused carrier) is supplied (resupplied) to the developing apparatus 14 at the same time that a toner is supplied (resupplied) while a carrier that deteriorated is discharged from the developing apparatus 14.

However, not only the carrier that deteriorated but the developer that the carrier that deteriorated and the toner are mixed is also discharged. Hereinafter, in this specification, although it says "The developer is discharged", etc., this means that the carrier that deteriorated or the developer that the carrier that deteriorated and the toner are mixed is discharged.

Thus, the carrier that deteriorated is replaced with an unused carrier. Although the carrier that deteriorated is not necessarily replaced with an unused carrier, the developing apparatus 14 is basically constituted such that the carrier that deteriorated is replaced with an unused carrier.

Therefore, in the developing apparatus 14, if a toner is consumed by forming an image on recording media such as a paper, the toner corresponding to a consumption amount is resupplied. To this end, a toner concentration detection sensor (not shown) is provided on the bottom of the developer vessel 140, for example, and toner concentration (T/D: T is a toner and D is a developer) in the developer vessel 140 is detected based on a detection result of this toner concentration detection sensor. Then, resupply of a toner is controlled according to the toner concentration detected.

In addition, as the toner concentration detection sensor, in general, a transmission-type optical sensor, a reflection-type optical sensor or a permeability sensor is used. For example, it is preferable to use a permeability sensor. The permeability is a rate of the magnetic material in a developer. Therefore, if a mixture ratio of a magnetic material and a nonmagnetic material in the developer changes, that is, if relative concentration of a magnetic material changes, an output of the permeability sensor changes. Therefore, the concentration of the carrier that is a magnetic material in the developer is measured by detecting the permeability of the developer. Alternatively, the concentration of the toner that is the nonmagnetic material in the developer is measured.

In such a developing apparatus 14, in order to uniformly and fully charge the toner in the developer vessel 140 while using for a long period of time as much as possible, when resupplying an unused toner from the toner cartridge 30, an unused career is also resupplied as mentioned above. Furthermore, a part of the developer that is stored in the developer vessel 140 is discharged. Therefore, the carrier that deteriorated is replaced with an unused carrier as mentioned above.

Therefore, it is important not only to control the amounts of the toner and the carrier that are resupplied but to suitably set discharge amounts of the carrier and the developer. For this reason, in the developing apparatus 14 of the first embodiment, following structure is adopted.

Figure 2:
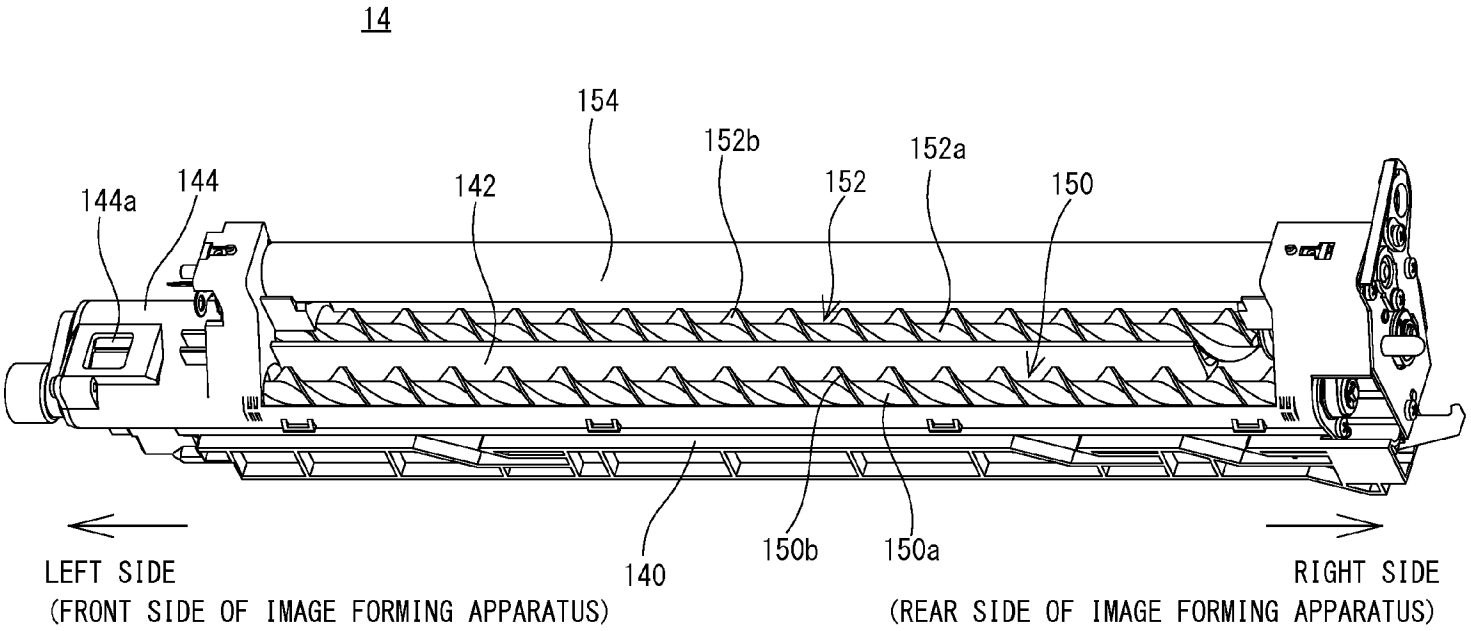
FIG. 2 is a perspective view diagonally viewing down specific appearance constitution of a developing apparatus shown in FIG. 1.
Figure 3:
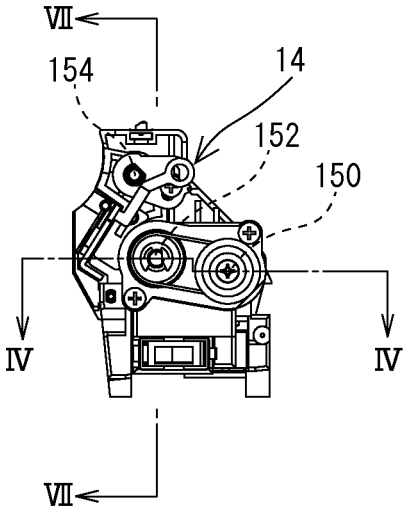
FIG. 3 is a schematic view viewing the developing apparatus shown in FIG. 2 from a left side surface.
Figure 4:
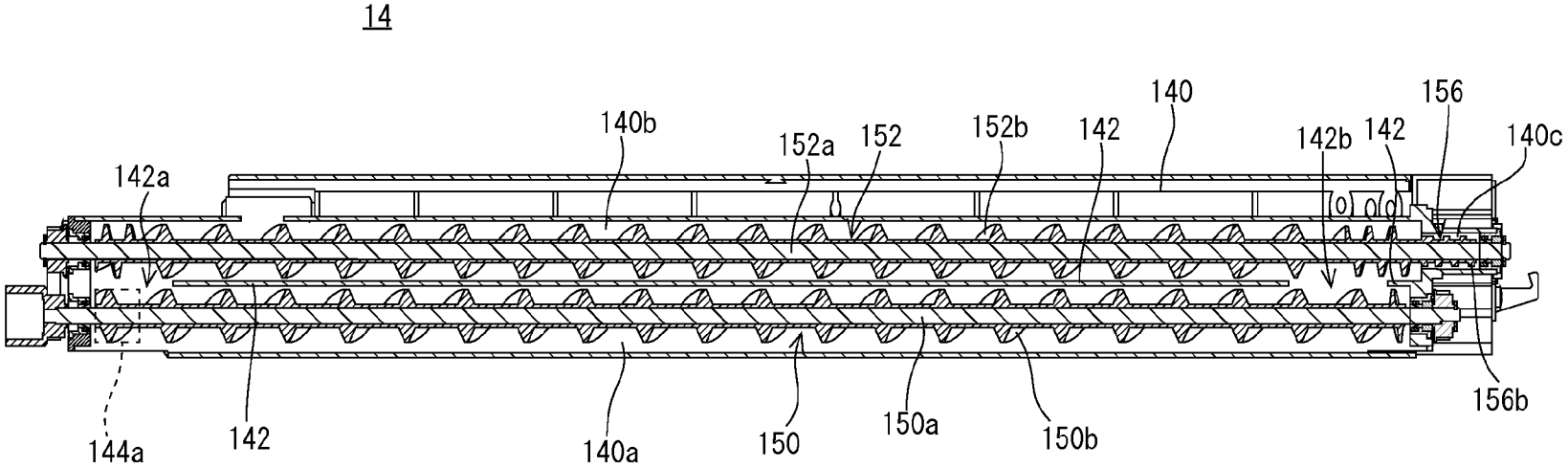
FIG. 4 is a sectional view at a line IV-IV in FIG. 3.

FIG. 2 is a perspective view obliquely viewing down specific appearance structure of the developing apparatus 14 shown in FIG. 1. Furthermore, FIG. 3 is a side view viewing the developing apparatus 14 shown in FIG. 2 from a left side. Furthermore, FIG. 4 is a IV-IV sectional view of FIG. 3.

It should be noted that a left side of the developing apparatus 14 shown in FIG. 2 is arranged in a front side of the image forming apparatus 10 shown in FIG. 1, and a right side of the developing apparatus 14 shown in FIG. 2 is arranged in a rear side of the image forming apparatus 10 shown in FIG. 1.

As shown in FIG. 2, the developing apparatus 14 includes the developer vessel 140, a partition wall 142, a developer vessel cover 144, a first transporting member 150, a second transporting member 152, a developing roller (magnet roller) 154 and a third transporting member 156.

In addition, the developer vessel cover 144 is a member that covers the first transporting member 150, the second transporting member 152 and the developing roller 154 above the developer vessel 140 in the vertical direction, and a part of the developer vessel cover 144 is omitted in FIG. 2.

Furthermore, although a doctor blade and the toner concentration detection sensor mentioned above are also included in the developing apparatus 14, the doctor blade and the toner concentration detection sensor are omitted in FIG. 2 as well as a part of the developer vessel cover 144.

The developer vessel 140 stores the developer (two-component developer) that the carrier and the toner are mixed, as mentioned above. In addition, the first transporting member 150, the second transporting member 152, the developing roller 154 and the third transporting member 156 mentioned above are provided inside the developer vessel 140.

However, the toner, the carrier and the developer that these are mixed are not shown.

Furthermore, a thing excluding the developing roller 154 and the doctor blade from the developing apparatus 14 may be called a transporting apparatus that transports the developer.

Furthermore, within the developer vessel 140, the first transporting member 150 and the second transporting member 152 are rotatable, and arranged such that the respective rotation axes are in parallel with each other as seen from FIG. 2-FIG. 4. The third transporting member 156 is formed coaxially and integrally with the second transporting member 152.

Furthermore, within the developer vessel 140, there is provided with a partitioning plate, i.e., the partition wall 142 that extends in a direction of the rotation axes of the first transporting member 150 and the second transporting member 152 between the first transporting member 150 and the second transporting member 152 so as to divide the developer vessel 140. Therefore, in the developer vessel 140, the first transporting path 140*a* that the developer is transported by the first transporting member 150 is formed and the second transporting path 140*b* that the developer is transported by the second transporting member 152 is formed. Furthermore, in the developer vessel 140, the third transporting path 140*c* for discharging the developer by the third transporting member 156 is formed. This third transporting path 140*c* is connected (coupled) to the second transporting path 140*b*.

Slits 142*a* and 142*b* are formed in both end portions of the partition wall 142. The first transporting path 140*a* and the second transporting path 140*b* are communicated with each other by these slits (communicating portions) 142*a* and 142*b*.

Furthermore, in the developer vessel 140, the developing roller 154 is arranged above the second transporting member 152 in the vertical direction. The developing roller 154 functions as a developer bearing member, and is arranged in a position opposite to the photoreceptor drum 12 (see FIG. 1). The developing roller 154 bears the developer within the developer vessel 140 on its surface and supplies the toner included in the developer that is borne to the surface of the photoreceptor drum 12. Therefore, as mentioned above, the electrostatic latent image that is formed on the surface of the photoreceptor drum 12 is developed (visualized).

In addition, although not shown, the doctor blade is fixed to the developer vessel 140 with a predetermined gap to the surface of the developing roller 154. In addition, the doctor blade is a tabular member extending in a direction of the axis of the developing roller 154. By this doctor blade, an amount of the developer that is borne on the developing roller 154 is regulated to a predetermined amount.

Furthermore, as shown in FIG. 2, the developing apparatus 14 is formed with a toner resupply port 144*a* for resupplying a toner and a carrier from the toner cartridge 30 above the first transporting member 150 on one end portion of the developer vessel cover 144. As mentioned above, the toner supply pipe extended from the toner cartridge 30 is coupled to this toner resupply port 144*a*.

In addition, the one end portion of the developer vessel cover 144 is an end portion in an upstream side of the transporting direction that the developer is transported by the first transporting member 150.

As shown in FIG. 2 and FIG. 4, the first transporting member 150 is an auger screw that blades (agitating vanes 150*b*) for transporting the developer while churning is formed on the rotation axis (screw axis 150*a*). In this first transporting member 150, the agitating vanes 150*b* is reversed in a downstream end portion (right end portion in FIG. 2 and FIG. 4) of the transporting direction of the developer.

The second transporting member 152 is also an auger screw that agitating vanes 152*b* for transporting the developer while churning is formed on the screw axis 152*a*. In the second transporting member 152, a pitch of the agitating vanes 152*b* is shortened in an upstream end portion (right end portion in FIG. 2 and FIG. 4) of the transporting direction of the developer. Furthermore, in the second transporting member 152, the agitating vanes 152*b* is reversed and a pitch of the agitating vanes 152*b* is shortened in a downstream end portion (left end portion in FIG. 2 and FIG. 4) of the transporting direction of the developer.

Furthermore, the third transporting member 156 is provided integrally with the second transporting member 152. The third transporting member 156 is coaxial with the second transporting member 152, and provided in the third transporting path 140*c*. Each of the second transporting path 140*b* and the third transporting path 140*c* is formed in a cylindrical shape or approximately cylindrical shape (the first transporting path 140*a* is also the same). The third transporting path 140*c* is coaxial with the second transporting path 140*b*, and a diameter of the cylindrical shape thereof is formed smaller than that of the second transporting path 140*b*. Therefore, a stepwise difference is formed in a connection portion of the second transporting path 140*b* and the third transporting path 140*c* (see FIG. 7). Since the second transporting path 140*b* and the third transporting path 140*c* are thus formed, even if the developing apparatus 14 inclines, for example, it is possible to prevent that a large amount of developer overflows to the third transporting path 140*c* from the second transporting path 140*b*. Therefore, the developer is not discharged from the third transporting path 140*c* more than required.

Furthermore, the third transporting member 156 has the rotation axis (screw axis 152*a*) that is coaxial with the rotation axis of the second transporting member 152, and the agitating vanes 156*b* that is reversed to the agitating vanes 152*b* of the second transporting member 152. In addition, an outer diameter of the agitating vanes 156*b* is made smaller than that of the agitating vanes 152*b*.

Figure 5:
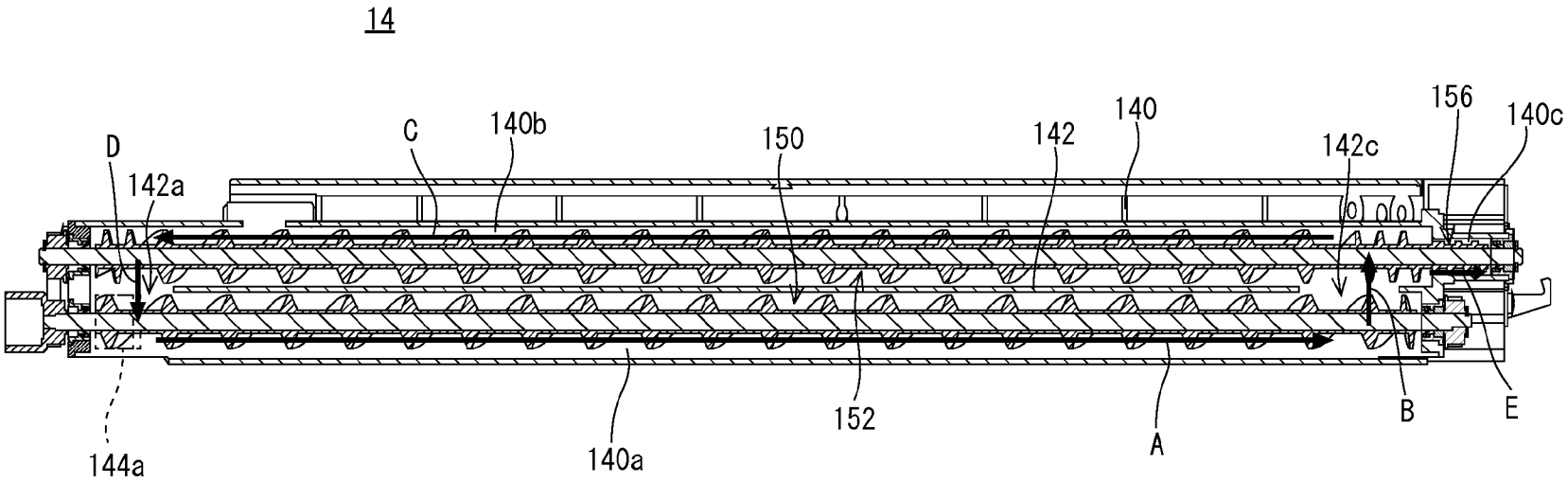
FIG. 5 is a schematic view showing the flow of a developer in the developing apparatus shown in FIG. 4.
Figure 6:
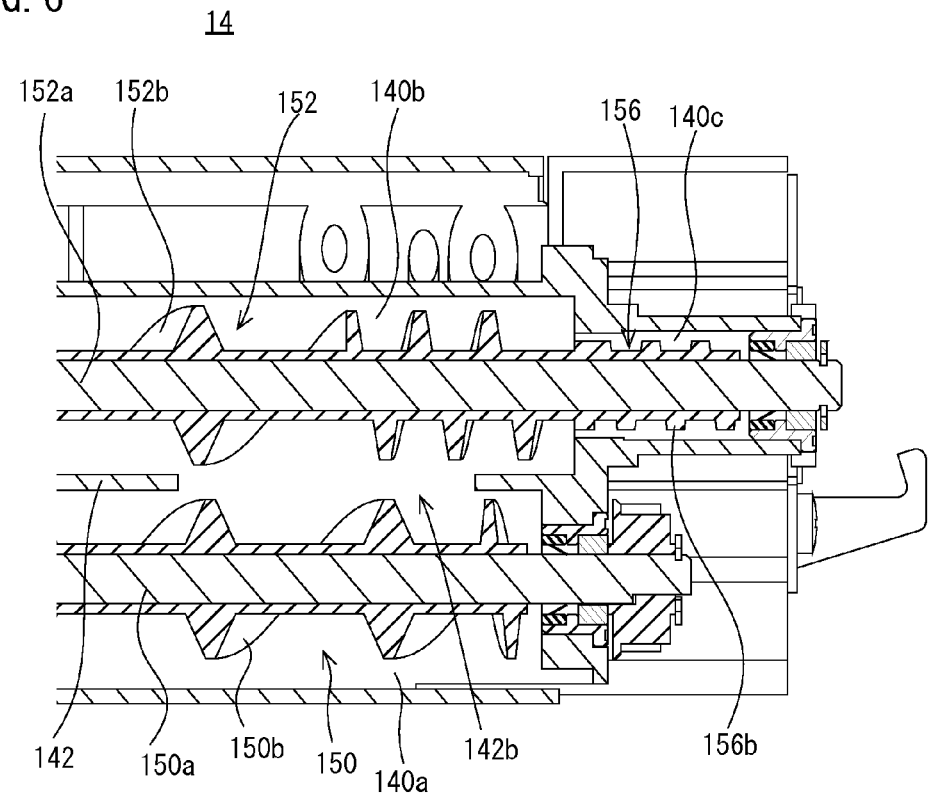
FIG. 6 is a schematic view enlarging a part of the sectional view shown in FIG. 4.

FIG. 5 is a schematic view adding the transporting direction of the developer in the sectional view of FIG. 4. Furthermore, FIG. 6 is an enlarged view that the right end portion of FIG. 4 is enlarged, and FIG. 7 is a view showing a part of VII-VII sectional view of FIG. 3.

Figure 7:
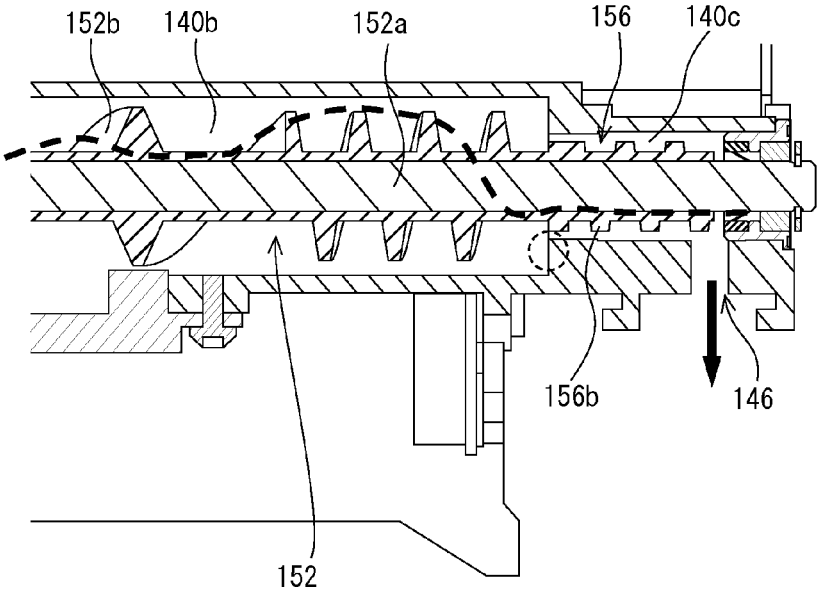
FIG. 7 is a schematic view showing a part of a sectional view at a line VII-VII in FIG. 3.

In addition, in FIG. 7, a part of an upstream side in the transporting direction of the developer of the second transporting path 140*b* and the third transporting path 140*c* are shown while omitting the developing roller 154 and the doctor blade.

In this first embodiment, the screw axis 150*a* of the first transporting member 150 and the screw axis 152*a* (154*a*) of the second transporting member 152 are rotated in reverse direction to each other. Therefore, in the first embodiment, the developer is transported in the first transporting path 140*a* toward a side of the slit 142*b* from a side of the slit 142*a*, and the developer is transported in the second transporting path 140*b* toward a side of the slit 142*a* from a side of the slit 142*b*. That is, the transporting direction of the developer transported in the first transporting path 140*a* and the transporting direction of the developer transported in the second transporting path 140*b* are in reverse.

Furthermore, the developer transported in the first transporting path 140*a* collides, in a downstream end portion in the transporting direction of the first transporting path 140*a*, with the developer that stays in the downstream side and the wall (inner side wall) of the developer vessel 140. Therefore, the developer stays in the downstream end portion of the transporting direction of the first transporting path 140*a*, and is pushed out (moved) through the slit 142*b* to the second transporting path 140*b*.

Furthermore, the developer transported in the second transporting path 140*b* collides, in a downstream end portion of the transporting direction of the second transporting path 140*b*, with the developer that stays in the downstream side and the wall (inner side wall) of the developer vessel 140. Therefore, the developer stays in the downstream end portion of the transporting direction of the second transporting path 140*b*, and is pushed out (moved) through the slit 142*a* to the first transporting path 140*a*.

Since the first transporting path 140*a* and the second transporting path 140*b* are thus communicated with each other by the slit 142*a* and the slit 142*b* within the developer vessel 140, the developer in the developer vessel 140 is circulated by rotating the first transporting member 150 and the second transporting member 152. In FIG. 5, as shown by arrow marks A, B, C and D, the developer is circulated inside the developer vessel 140.

Here, as mentioned above, the toner resupply port 144*a* is formed in the upstream side (left end portion in FIG. 4 and FIG. 5) of the transporting direction of the developer in the first transporting path 140*a*. Therefore, an unused toner from the toner cartridge 30 is resupplied to the upstream side of the transporting direction of the developer in the first transporting path 140*a* together with an unused carrier.

Furthermore, as also seen in FIG. 6 and FIG. 7, the third transporting path 140*c* is coaxial with the second transporting path 140*b*, and its diameter (size) of the cylinder shape that forms the third transporting path 140*c* is smaller than that of the second transporting path 140*b*. Therefore, in the vertical direction, the bottom of the third transporting path 140*c* is located above the bottom of the second transporting path 140*b*. That is, a stepwise difference is formed in the connection (coupling) portion of the second transporting path 140*b* and the third transporting path 140*c*. In addition, in FIG. 7, a portion of the stepwise difference is surrounded with a circle of dotted line. Therefore, if the developer surmounts the above-mentioned stepwise difference and overflows from the second transporting path 140*b* to the third transporting path 140*c* in the upstream end portion of the transporting direction of the developer in the second transporting path 140*b*, the developer that overflows is transported by the third transporting member 156 in a direction reverse to the transporting direction in the second transporting path 140*b*. Therefore, the developer that overflows is discharged from the toner discharge port 146. As shown by a thick dotted line in FIG. 7, for example, if a surface of the developer surmounts the stepwise difference in the third transporting path 140*c*, a part of the developer that surmounts is transported to the toner discharge port 146 in a direction shown by an arrow mark E of FIG. 5.

Thus, in the developing apparatus 14 of the first embodiment, it is constructed such that the developer that overflows to a side of the third transporting path 140*c* in the upstream end portion of the transporting direction of the developer in the second transporting path 140*b* can be discharged. Furthermore, the sizes of the second transporting path 140*b* and the third transporting path 140*c*, etc. are determined to adjust a discharge amount of the developer, thereby to keep the amount of the developer that is stored in the developer vessel 140 and the toner concentration constant.

In addition, it is supposed that the developing apparatus 14 (developer vessel 140) is provisionally constructed such that the developer is discharged in the downstream side of the transporting direction of the developer in the first transporting path 140*a*. That is, it is assumed that the third transporting path 140*c* is provided in the downstream end side of the transporting direction of the developer in the first transporting path 140*a*, and the third transporting member 156 is formed integrally and coaxially with the transporting member 150. Then, the developer transported in the first transporting path 140*a* overflows to the third transporting path 140*c* with an impetus that is hardly reduced. In this, the developer is discharged excessively.

In such a case, even if lengthening a length that the agitating vanes 150*b* of the first transporting member 150 is reversed in the downstream side of the transporting direction of the developer, it is difficult to reduce the impetus of the transporting in the transporting direction, and therefore, the developer is discharged excessively. Furthermore, if lengthening the length that the agitating vanes 150*b* of the first transporting member 150 is reversed in the downstream side of the transporting direction of the developer too much, the developer becomes not to circulate within the developer vessel 140.

In addition, a case where the developing apparatus 14 (developer vessel 140) is provisionally constructed such that the developer is discharged in the downstream side of the transporting direction of the developer in the second transporting path 140*b* is, as mentioned above, similar to the case where the developer is discharged in the downstream side of the transporting direction of the developer in the first transporting path 140*a*.

Furthermore, in a case where the developing apparatus 14 (developer vessel 140) is provisionally constructed such that the developer is discharged in the upstream side of the transporting direction of the developer in the first transporting path 140*a*, it is impossible to exchange the carrier that deteriorated with an unused carrier because an unused toner and an unused carrier that are resupplied are discharged as they are.

Therefore, in the first embodiment, it is constructed such that the developer that overflows to the third transporting path 140*c* is discharged in the upstream side of the transporting direction of the developer in the second transporting path 140*b*.

According to the first embodiment, since the developer that overflows to the third transporting path 140*c* is discharged in the upstream side of the transporting direction of the developer in the second transporting path 140*b*, it is possible prevent the developer from being discharged excessively without the influence by the impetus of the developer transported in the first transporting path 140*a* and the second transporting path 140*b*.

Furthermore, according to the first embodiment, since the diameter of the cylindrical shape of the third transporting path 140*c* is made smaller than the diameter of the cylindrical shape of the second transporting path 140*b* such that the coupling portion of the second transporting path 140*b* and the third transporting path 140*c* is formed with the stepwise difference, even if the developing apparatus 14 inclines, only a few developer overflows to a side of the third transporting path 140*c*. That is, the developer can be prevented as possible from being discharged uselessly.

Second Embodiment

Since the image forming apparatus 10 of the second embodiment is the same as the first embodiment except changing a part of structure of the developing apparatus 14, a duplicate description is omitted.

Briefly describing, in the second embodiment, in a downstream side of a transporting direction of the developer in the first transporting path 140*a*, the impetus of the developer transported in this transporting direction is reduced.

The impetus of the developer transported in the first transporting path 140*a* toward the transporting direction is reduced when the developer collides, in a downstream side of the transporting direction, with the developer that stays near that portion and the inner side wall of the developer vessel 140. However, the developer transported in the first transporting path 140*a* includes a developer that the impetus toward the transporting direction is not reduced and is transported to the second transporting path 140*b* as it is. In such a case, since the impetus toward the downstream side of the transporting direction of the developer in the first transporting path 140*a* is not reduced, there is an occasion that the developer jumps over the stepwise difference with the impetus not reduced and thus overflows to the third transporting path 140*c*. In this, the developer becomes to be discharged excessively. In order to avoid such inconvenience, in the downstream side of the transporting direction of the developer in the first transporting path 140*a*, the impetus of the developer transported in this transporting direction is reduced.

Figure 8:
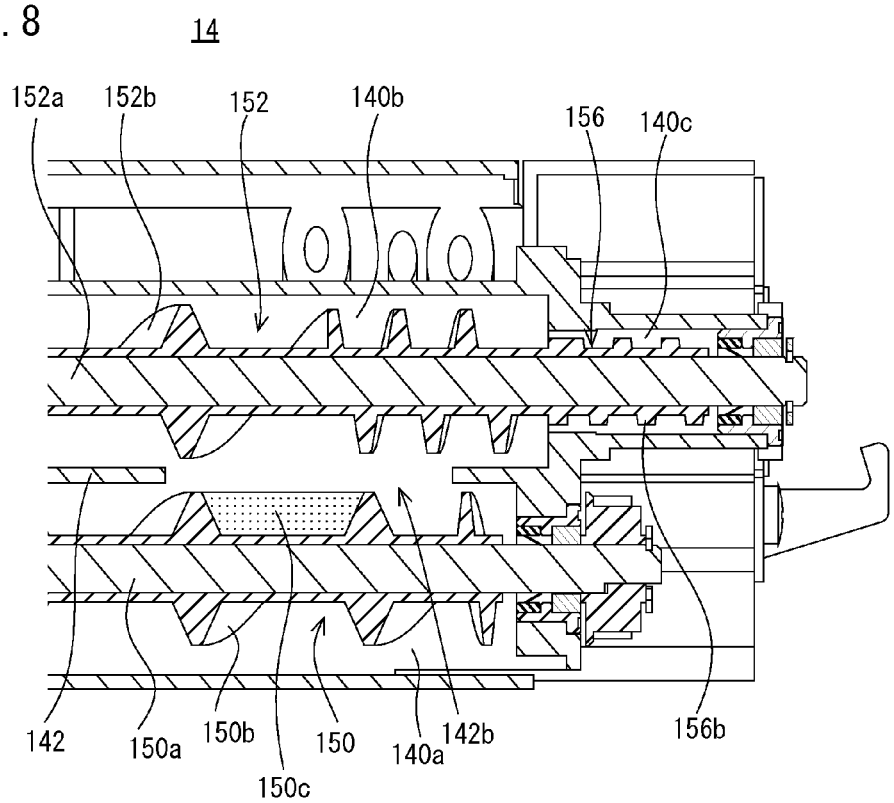
FIG. 8 is a schematic view enlarging a part of a sectional view of a developing apparatus of a second embodiment.

Specifically, as shown in FIG. 8, in the downstream side of the transporting direction of the developer by the first transporting member 150, there is provided with, in parallel with the screw axis 150*a*, with a plate (paddle) 150*c* that extends radially from the center of the screw axis 150*a* in the agitator groove in a position opposite (corresponding) to a position that the slit 142*b* is formed.

In addition, in order to show the paddle 150*c* intelligibly, spots are added in FIG. 8.

By providing this paddle 150*c*, it is possible to stay the developer in an upstream side than the paddle 150*c* in the transporting direction of the developer in the first transporting path 140*a*. Therefore, the impetus of the developer transported in the first transporting path 140*a* is reduced in the upstream side than the paddle 150*c*. Furthermore, the developer transported in the first transporting path 140*a* is prevented from being transported to the second transporting path 140*b* through the slit 142*b* as it is without reducing the impetus toward the transporting direction.

In addition, in this second embodiment, although a single paddle 150*c* is provided in the agitator groove, not need to be limited to this. For example, two or more paddles 150*c* may be provided in a single agitator groove while deviated from each other in a circumferential direction. Furthermore, a single or a plurality of paddles 150*c* may be provided in a plurality of agitator grooves. It should be noted that the paddle 150*c* is provided in a right end portion of the first transporting member 150 such that the developer stays near the slit 142*b* and in the upstream side than the slit 142*b* in a direction shown by an arrow mark A.

According to the second embodiment, the developer is effectively prevented from being discharged excessively.

Third Embodiment

Since the image forming apparatus 10 of the third embodiment is the same as the first embodiment except changing a part of structure of the developing apparatus 14, a duplicate description is omitted.

In the third embodiment, in a downstream side of a transporting direction of the developer in the first transporting path 140*a*, the impetus of the developer transported in this transporting direction is reduced.

Figure 9:
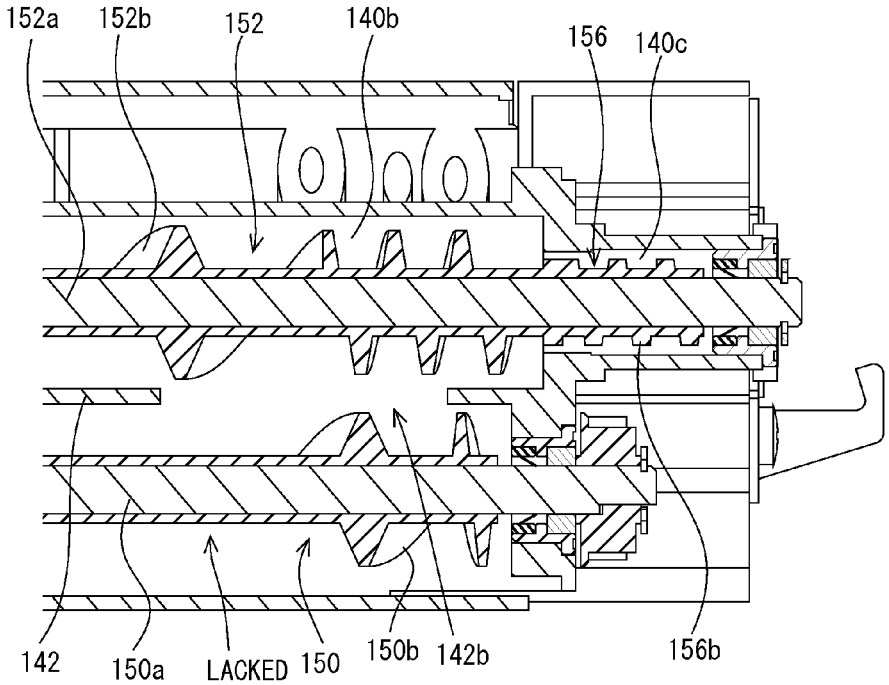
FIG. 9 is a schematic view enlarging a part of a sectional view of a developing apparatus of a third embodiment.

Specifically, as shown in FIG. 9, a part of the agitating vanes 150*b* of the first transporting member 150 lacks in a position opposite (corresponding) to a position that the slit 142*b* is formed. In addition, as mentioned in the second embodiment, in order to prevent the developer from overflowing to the third transporting path 140*c* through the slit 142*b* in a state where the impetus of the developer transported in the first transporting path 140*a* is not reduced, a part of the agitating vanes lacks in an upstream side than the position corresponding to the center of the slit 142*b* in the transporting direction of the developer. Alternatively, the pitch of the agitating vanes 150*b* is lengthened in this position.

According to the third embodiment, like the second embodiment, the developer is effectively prevented from being discharged excessively.

Fourth Embodiment

Since the image forming apparatus 10 of the fourth embodiment is the same as the first embodiment except changing a part of structure of the developing apparatus 14, a duplicate description is omitted.

In this fourth embodiment, an amount of the developer transported to the second transporting path 140*b* from the first transporting path 140*a* as it is through the slit 142*b* is reduced.

Figure 10:
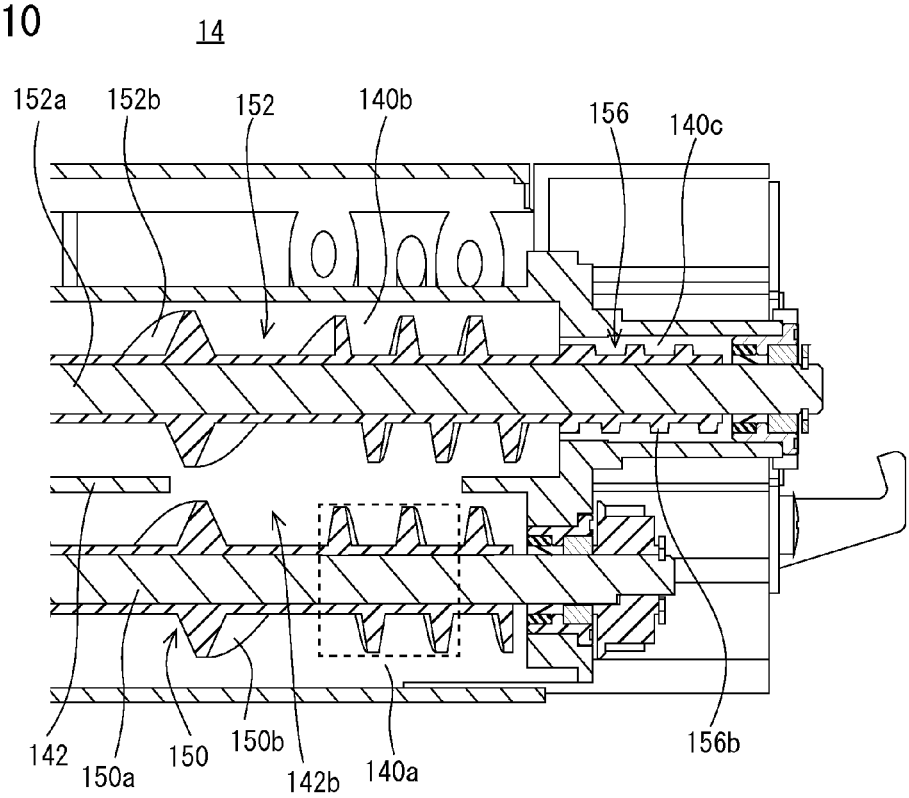
FIG. 10 is a schematic view enlarging a part of a sectional view of a developing apparatus of a fourth embodiment.

Specifically, as shown in FIG. 10, the number of turns of the agitating vanes 150*b* that is reversed in the downstream side of the transporting direction of the developer in the first transporting path 140*a* is increased. That is, the length of the agitating vanes 150*b* in reverse is lengthened. Therefore, a range that the developer stays spreads to the upstream side of the transporting direction as much as the agitating vanes 150*b* in reverse is extended, in the downstream end portion of the transporting direction of the developer in the first transporting path 140*a*. Therefore, since a part of slit 142*b* is closed by the developer that stays, an amount of the developer transported to the second transporting path 140*b* from the first transporting path 140*a* as it is through the slit 142*b* is reduced.

In the example shown in FIG. 10, the agitating vanes 150*b* that is reversed is extended up to the position opposite (corresponding) to the center of the slit 142*b* as shown by a rectangular frame of a dotted line. In addition, when extending reversed agitating vanes 150*b*, in replace with increasing the number of turns of the reversed agitating vanes 150*b*, or in addition to increasing the number of turns, the pitch of the agitating vanes 150*b* may be lengthened.

In addition, since the developer becomes not to circulate within the developer vessel 140 when the reversed agitating vanes 150*b* is extended too much toward the upstream side of the transporting direction of the developer, it is necessary to extend the reversed agitating vanes 150*b* toward the upstream side to such an extent that such inconvenience does not occur.

According to the fourth embodiment, since an amount of the developer transported from the first transporting path 140*a* to the second transporting path 140*b* as it is through the slit 142*b* is reduced, the developer is effectively prevented from being discharged excessively.

Fifth Embodiment

Since the image forming apparatus 10 of the fifth embodiment is the same as the first embodiment except changing a part of structure of the developing apparatus 14, a duplicate description is omitted.

In the fifth embodiment, like the fourth embodiment, an amount of the developer transported from the first transporting path 140*a* to the second transporting path 140*b* as it is through the slit 142*b* is reduced.

Figure 11:
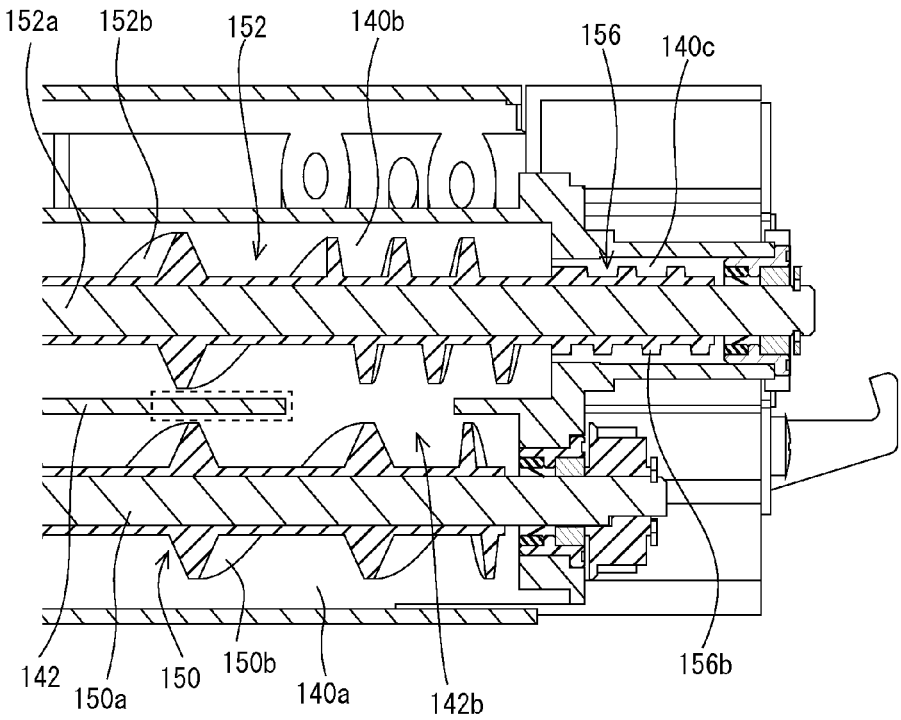
FIG. 11 is a schematic view enlarging a part of a sectional view of a developing apparatus of a fifth embodiment.

Specifically, as shown in FIG. 11, a width of the slit 142*b* is narrowed. That is, the length of the partition wall 142 is extended to the downstream side of the transporting direction of the developer in the first transporting path 140*a*. In FIG. 11, for example, a portion that the partition wall 142 is extended is shown by a rectangular frame of a dotted line. This extended portion (blocking portion) functions as a wall, and therefore, it is possible to block the developer transported in the first transporting path 140*a* from being transported to the second transporting path 140*b* through the slit 142*b* as it is.

In addition, although the partition wall 142 is extended in the fifth embodiment, a single or a plurality of plates (walls) may be provided in parallel with the partition wall 142 so as to divide the slit 142*b*.

In addition, since there is an occasion that it becomes difficult to push out the developer from the first transporting path 140*a* to the second transporting path 140*b* and thus the developer becomes not to be circulated within the developer vessel 140, if narrowing the width of the slits 142*b* too much, it is necessary to extend the partition wall 142 to such an extent that such inconvenience does not occur.

According to the fifth embodiment, like the fourth embodiment, the developer is effectively prevented from being discharged excessively.

Sixth Embodiment

Since the image forming apparatus 10 of the sixth embodiment is the same as the first embodiment except changing a part of structure of the developing apparatus 14, a duplicate description is omitted.

Briefly describing, it is constructed that even if the developer is transported from the first transporting path 140*a* to the second transporting path 140*b* through the slit 142*b* as it is, the developer is made not to overflow or difficult to overflow.

Figure 12:
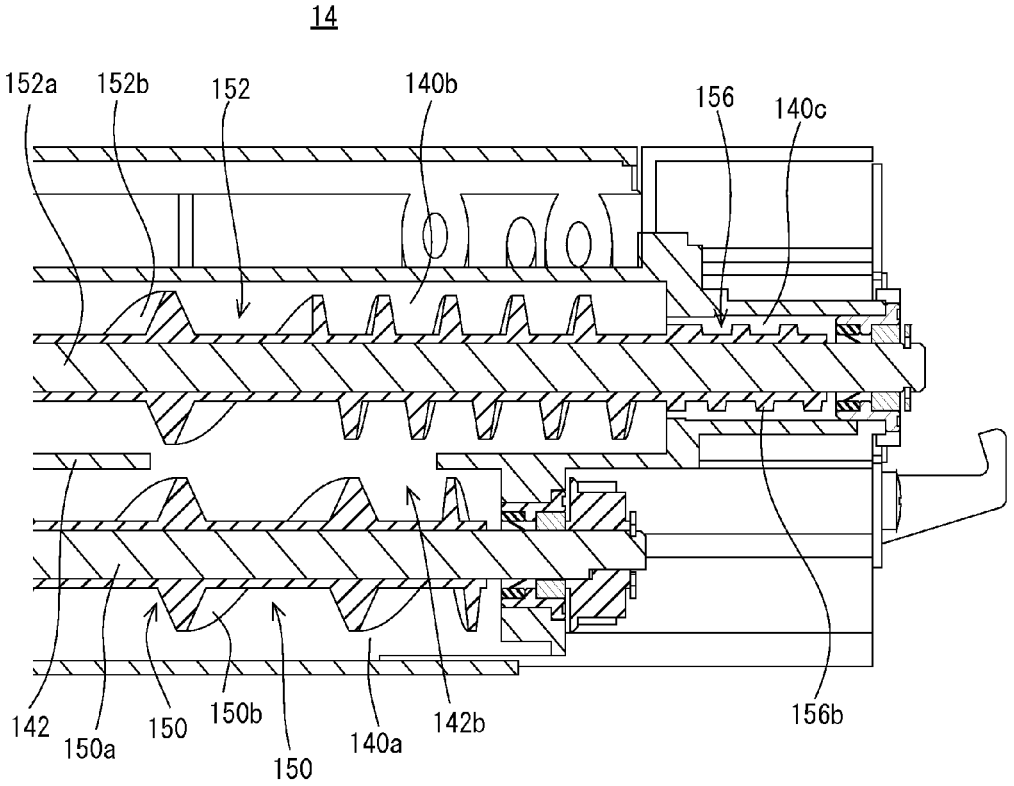
FIG. 12 is a schematic view enlarging a part of a sectional view of a developing apparatus of a sixth embodiment.

In the sixth embodiment, as shown in FIG. 12, the second transporting path 140*b* and the second transporting member 152 are extended in the upstream side of the transporting direction of the developer in the second transporting path 140*b*. Therefore, a distance from the slit 142*b* to the third transporting path 140*c* is lengthened. That is, an extended portion (blocking portion) of the second transporting path 140*b* can block the developer transported in the first transporting path 140*a* from being transported with the impetus not reduce to the third transporting path 140*c*.

In addition, with having extended the second transporting path 140*b*, the second transporting member 152 is also extended and thus the number of turns of the agitating vanes 152*b* in the right end portion is increased.

In addition, since the developer that should be discharged becomes not overflow to the third transporting path 140*c* if the second transporting path 140*b* is extended too much, it is necessary to extend the second transporting path 140*b* to such an extent that such inconvenience does not occur.

According to the sixth embodiment, like the fourth embodiment, the developer is effectively prevented from being discharged excessively.

In addition, although the change of the structure of the developing apparatus 14 shown in each of the above-mentioned second to sixth embodiments is explained individually, two or more out of the change in the second embodiment and the changes in the fourth to sixth embodiments may be simultaneously adopted. Similarly, two or more out of the changes in the third to sixth embodiments may adopted simultaneously.

Although the present invention has been mentioned and illustrated in detail, it is clearly understood that the same is by way of illustration and example only and is not to be taken by way of limitation, the spirit and scope of the present invention being limited only by the terms of the appended claims.

What is claimed is:

1. A transporting apparatus, comprising:

a first transporting member configured to transport a developer while churning in a first transporting path in a developer vessel;

a second transporting member configured to transport the developer while churning in a direction reverse to the first transporting member in a second transporting path that is arranged in parallel with the first transporting path in the developer vessel, and supplies the developer to a developer bearing member;

a third transporting path that is connected to the second transporting path in an upstream side of a transporting direction of the developer by the second transporting member; and a third transporting member configured to transport the developer that overflows from the second transporting path to the third transporting path to a discharge port, wherein the second transporting path is extended toward the upstream side of the transporting direction of the developer by the second transporting member such that an upstream end of the transporting direction of the developer by the second transporting member is arranged beyond a downstream end of a transporting direction of the developer by the first transporting member.

2. The transporting apparatus according to claim 1, wherein the second transporting path and the third transporting path is cylindrical or approximately cylindrical shape, and the third transporting path has a diameter of the cylindrical shape smaller than that the second transporting path, and is formed coaxially with the second transporting path.

3. The transporting apparatus according to claim 1, wherein the first transporting member is formed so as to reduce an impetus of the developer toward the transporting direction in a downstream side of the transporting direction of the developer.

4. The transporting apparatus according to claim 3, wherein the first transporting member has a screw for transporting the developer while churning, further comprising a plate that extends radially from a center of a screw axis and is arranged in parallel with the screw axis is provided on a part of an agitator groove in a position corresponding to a communicating portion between the first transporting path and the second transporting path in a downstream side of the transporting direction of the developer by the first transporting member.

5. The transporting apparatus according to claim 3, wherein the first transporting member has a screw for transporting the developer while churning, and a part of agitating vanes lacks in a position corresponding to a communicating portion between the first transporting path and the second transporting path in a downstream side of the transporting direction of the developer by the first transporting member.

6. The transporting apparatus according to claim 1, wherein the first transporting member has a screw for transporting the developer while churning, and agitating vanes for transporting the developer in a direction reverse to the transporting direction by the first transporting member is provided up to a position corresponding to the communicating portion between the first transporting path and the second transporting path in a downstream side of the transporting direction of the developer in the first transporting member.

7. The transporting apparatus according to claim 1, further comprising a blocking portion that blocks the developer from being directly transported from the first transporting path to the second transporting path in a position corresponding to the communicating portion between the first transporting path and the second transporting path in a downstream side of the transporting direction of the developer by the first transporting member.

8. The transporting apparatus according to claim 7, wherein the blocking portion includes a wall that narrows a width of the communicating portion.

9. The transporting apparatus according to claim 7, wherein the blocking portion includes a part of the second transporting path that is extended toward an upstream side of the transporting direction of the developer by the second transporting member.

10. A developing apparatus, comprising the transporting apparatus according to claim 1 and a developer bearing member.

11. An image forming apparatus, comprising the transporting apparatus according to claim 1.

* * * * *